US006371119B1

(12) United States Patent
Zadini et al.

(10) Patent No.: US 6,371,119 B1
(45) Date of Patent: Apr. 16, 2002

(54) TILTABLE BACKBOARD FOR CARDIOPULMONARY RESUSCITATION

(76) Inventors: Filiberto P. Zadini; Giorgio Zadini, both of 2237 Hilltop La., Camarillo, CA (US) 93012

( * ) Notice: Subject to any disclaimer, the term of this patent is extended or adjusted under 35 U.S.C. 154(b) by 0 days.

(21) Appl. No.: 09/419,194

(22) Filed: Oct. 15, 1999

(51) Int. Cl.[7] ..... A61G 15/00
(52) U.S. Cl. ..... 128/845; 128/870
(58) Field of Search ..... 128/845, 846, 128/869, 870; 5/630, 636, 641–645

(56) References Cited

U.S. PATENT DOCUMENTS

| | | | | | |
|---|---|---|---|---|---|
| 2,314,080 | A | * | 3/1943 | Dine | 128/845 |
| 3,783,863 | A | * | 1/1974 | Kliever | 128/870 |
| 4,911,106 | A | * | 3/1990 | Goodwin | 128/870 |
| 5,131,103 | A | * | 7/1992 | Thomas | 128/870 |
| 5,400,448 | A | * | 3/1995 | Zwickey | 128/870 |

* cited by examiner

*Primary Examiner*—Michael A. Brown
(74) *Attorney, Agent, or Firm*—Robert D. Buyan; Stout, Uxa, Buyan & Mullins, LLP

(57) ABSTRACT

An apparatus and method to be used in CPR to promote diastolic filling of the heart in cardiac arrest situations during external or internal cardiac compression. A rigid backboard provided with a tilting apparatus to incline the backboard to a desired degree. The backboard can be also provided with a tiltable segment for forward head flexion. The body of a patient victim of cardiac arrest is placed supine over the rigid backboard and the backboard is tilted by actuation of the tilting apparatus to a desired angle thus positioning the patient with feet up and chest down, so that the lower extremities are higher than the abdomen and tilted down toward the abdomen, and the abdomen higher than the chest and tilted down toward the chest. Likewise, being the head flexed forward in respect to the remainder of the body, the head is positioned higher than the heart, and tilted down toward the heart. As a result of such a positioning, the blood in the venous system of the lower extremities, of the abdomen and head will be draining down toward the heart by gravity improving diastolic filling and ultimately will improve cardiac output with internal or external cardiac compressions being carried out with the patient maintained in such position.

21 Claims, 4 Drawing Sheets

TILTABLE BACKBOARD FOR CARDIOPULMONARY RESUSCITATION

FIELD OF THE INVENTION

This invention relates to aid devices for cardiac resuscitation, more specifically to devices and methods to improve blood return to the heart in patients that are victims of cardiac arrest.

BACKGROUND—DESCRIPTION OF THE PRIOR ART

Backboards have been part of the armamentarium of emergency care for many years. Every ambulance carries a backboard. Backboards have their place in emergency care because they are essential to the immobilization and transportation of patients with suspected spinal injuries. The other major indication and use of backboards in emergency care is in the field of cardiac resuscitation. As taught by the American Heart Association, in case of cardiac arrest for resuscitative efforts the victim must be placed supine and on a firm flat surface in order to optimize external cardiac compression. It is accepted practice to place the victim of a cardiac arrest on a hard and unyielding surface such as the floor or the ground prior to initiating cardiopulmonary resuscitation. If the victim is on a bed or an ambulance stretcher, a backboard is always placed under the patient's back by a paramedic, physician or nurse. Indeed attempting to compress the patient's chest while the patient lays on a mattress or other non rigid surface will result only in pushing the patient's whole body downward during external cardiac compression, without achieving the desired chest compression. Backboards are therefore widely used nowadays as an important adjunt in emergency cardiac care.

External chest compression provides circulation to the heart, lungs, brain and other organs as a result of a generalized increase in intrathoracic pressure and/or direct compression of the heart against the thoracic spine. During cardiac arrest, properly performed external chest compression can produce systolic blood pressure peaks of more than 100 mm Hg, but the diastolic blood pressure is low. The goal of cardiopulmonary resuscitation is to provide blood flow to vital organs until more definitive care such as defibrillation and pharmacological therapy can be provided. Many patients have extremely poor perfusion during CPR. Several alterations in the technique of CPR have been proposed to improve hemodynamics: CPR and with elevation of the lower extremities, Interposed Abdominal Compression IAC/CPR, High-Frequency also called Rapid Compression Rate CPR. Mechanical devices that can be used as substitutes for manual chest compressions have also been developed such as Cardiac Press, Automatic Resuscitators, Pneumatic Antishock Garment, Vest CPR, and Active Compression-Decompression CPR.

A major problem, if not the number one problem of poor perfusion during CPR, common to all the above techniques and devices, is the insufficient/inadequate venous return of blood to the heart. Indeed, it is well known that diastolic filling during CPR is only a fraction of the diastolic filling of the pre-arrest condition. The inventors, experts in the field of resuscitation, are unaware of any CPR technique or device that promotes adequate diastolic filling such as the one subject of the invention. Indeed an extensive search in the pertinent medical literature and in the Patent Office failed to disclose any apparatus or method for improving diastolic filling of the heart by gravity during cardiac arrest such as the apparatus and method disclosed in this invention.

BRIEF SUMMARY OF THE INVENTION

With the present invention the inventors propose a simple solution to the problem of insufficient diastolic filling during external or open cardiac massage. Essentially, the invention uses gravity in order to enhance blood return to the heart from the lower extremities, from the pelvis, from the abdomen, from the upper extremities and from the head.

The present invention comprises a tiltable backboard for cardiac resuscitation which promotes venous return by gravity during external or internal chest compression. It consists of a standard backboard made of plastic or wood or any suitable rigid material provided with a feature or a mechanism which permits adjustable tilting with respect to the flat surface of a floor or a bed or a gurney.

The backboard is also provided with the capability of tilting the head of the patient forward with respect to the remainder of the body. In use the body of a patient who is a victim of cardiac arrest is placed supine on the board. The board is tilted by a certain degree by raising the distal end so as to position the body of the patient inclined with his chest down and his feet up. The head of the patient can be tilted forward to promote blood return from the head to the heart. Being the patient positioned with the feet up and the chest down, so that the lower extremities are higher than the pelvis and abdomen and tilted down toward the pelvis and abdomen, and the pelvis and abdomen higher than the chest and tilted down toward the chest, the blood within the venous system of the lower extremities and the pelvis and abdomen will move by gravity toward the chest into the heart promoting diastolic filling. Being the head flexed forward in respect to the remainder of the body, and therefore positioned higher than the heart, the blood in the venous system of the head will be draining downward to the heart by gravity.

The angle of inclination of the tiltable board is adjustable from zero degree to 60 or more. This invention provides a simple means of promoting a blood return into the heart in patients victim of cardiac arrest when external or internal cardiac compression is applied.

OBJECT OF THE PRESENT INVENTION

It is an object of the present invention to provide a simple, rapidly deployable and effective means of promoting venous blood return during external or internal CPR.

It is an object of the present invention to provide emergency care workers with a simple effective apparatus and method for improving diastolic filling of the heart during cardiac resuscitation.

It is an object of the present invention to provide emergency care workers with a simple and effective apparatus and method of improving diastolic filling and cardiac output during external or internal cardiac massage.

It is an object of the present invention to provide emergency care workers with a device which is very simple to deploy and use at the scene of a cardiac arrest whether the arrested patient lays on the floor, on a bed, or on a gurney.

DRAWING FIGURES

DETAILED DESCRIPTION OF THE DEVICE

Figure 1:
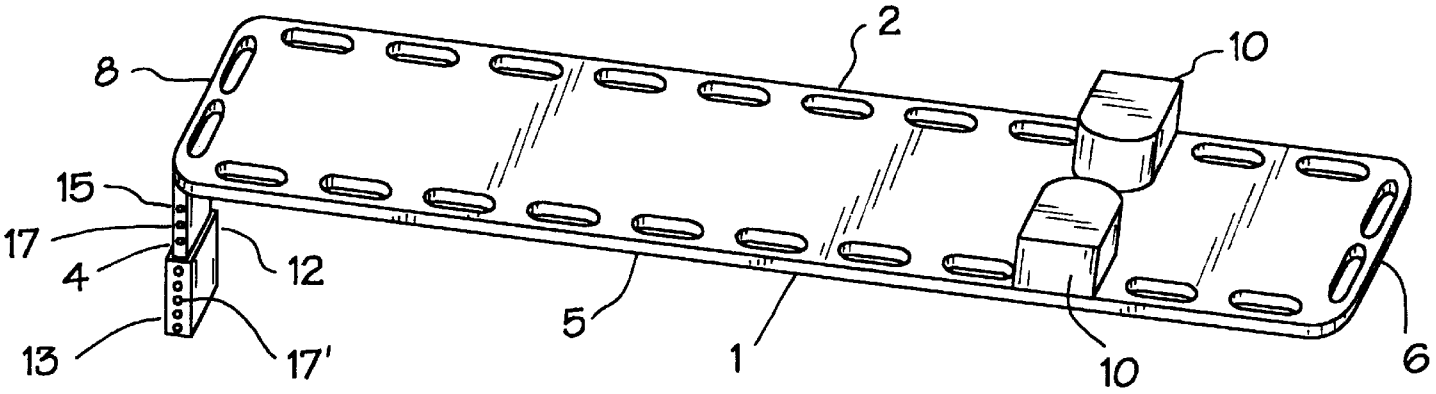
FIG. 1 is a side view of the tiltable backboard, tilted with the tiltable apparatus deployed.

The device, generally indicated at 1, is composed of backboard for emergency care 2 made of rigid material such as wood, plastic, metal or any other suitable material with same characteristics and tilting apparatus or means 4. Backboard 2 has proximal end 6, body 5, distal end 8 and shoulders arrest or an apparatus for arresting the sliding of a patient 10.

Figure 1A:
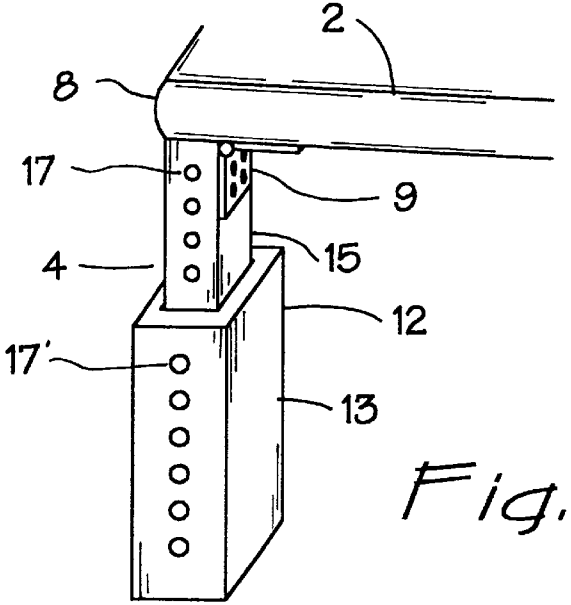
FIG. 1A is a front view of a detail of the tiltable backboard, in particular the tiltable apparatus as deployed.

As better shown in FIG. 1A, tilting apparatus 4 includes adjustable telescopically sliding legs 12 attached via hinges 9 to distal end 6 of backboard 2. Legs 12 are composed of an outer tube 13 and an inner tube 15 which is telescopically slidable within the outer tube 13. Inner tube 15 is provided with multiple outwardly resilient pins 17 which can engage corresponding holes 17' formed in outer tube 13 for adjustable sliding of tube 15 within tube 13. Hinges 9 facilitate transport of the backboard by allowing folding of legs 12. A number of different types of means may function to tilt the backboard 2, such as cranking lifters operated by foot or hand, suitable hydraulic mechanical or pneumatic jacks, and the like. Tilting apparatus may also tilt backboard 2 at a fixed, non adjustable angle: in such cases tilting apparatus consists essentially of supports connected to the back of backboard 2 to achieve tilting of the backboard.

Shoulder arrests 10, which may be blocklike, made of foam or rubber or any suitable material serve the purpose of arresting the downward sliding of the patient body when the backboard is in the tilted position. Alternatively chest or shoulders straps such as velcro straps can be also used to arrest the downward sliding of the patient when placed in Trendelenburg position.

In use, a patient in cardiac arrest is placed supine along the backboard. The backboard is tilted in the horizontal plane by deploying tilting apparatus 4. Tilting apparatus 4 is deployed by unfolding of legs 12 in a vertical position. The length of legs 12 can be adjusted by the operator by the sliding of outer tube 15 over inner tube 13. Any of pins 17 will engage corresponding holes 17' and will lock legs 12 at the desired length. Tiltable backboard 1 can be tilted by various degrees just by shortening or lengthening legs 12 of tilting apparatus 4. Fifteen degree of inclination or even less can be sufficient to improve venous blood return by gravity to the heart. Shoulder rests 10 will not allow the sliding of the patient when the board is maintained in an inclined position during CPR. The patient lying on the backboard will remain with the chest at a lower level than the abdomen, pelvis, lower extremities. Upper extremities can be positioned along side the patient's trunk for elevation from distal to proximal end. With the patient's chest positioned at a level below the abdomen, pelvis, and extremities, venous blood from the abdomen, pelvis, and extremities will move by gravity down toward the chest and the heart.

External or internal cardiac compressions, Closed or Open Chest CPR, are carried out while the patient is lying head down on the backboard. Any of the backboards disclosed herein can be used for direct cardiac massage performed with the Percutaneous Cardiac Pump for CPR disclosed by Zadini et al. in U.S. Pat. Nos. 5,466,221, 5,683,364 and 5,931,850.

Figure 2:
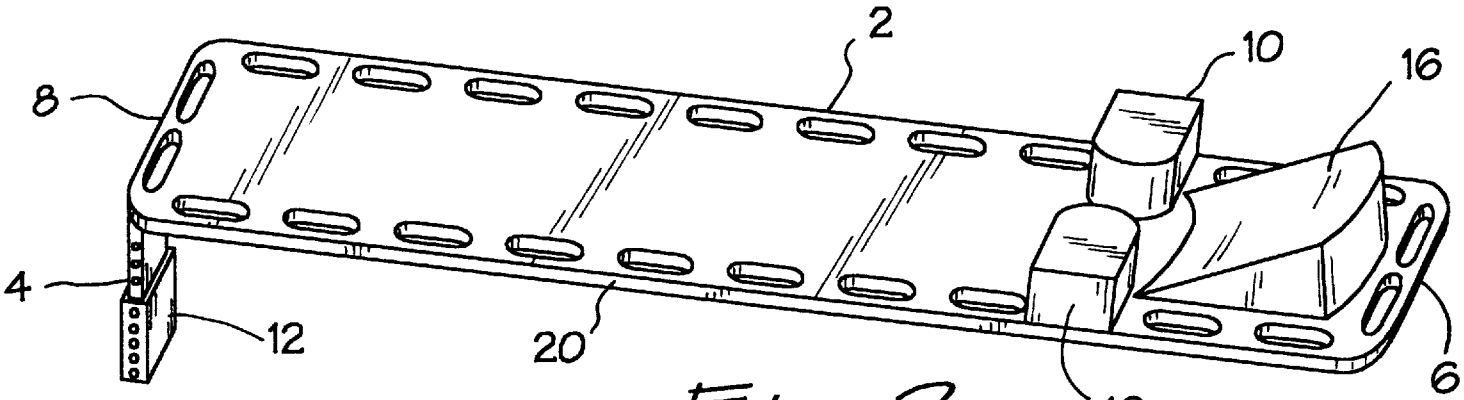
FIG. 2 is a side view of a further embodiment of the tiltable backboard in use with ahead rest for elevation of the head of the patient.

FIG. 2 a further embodiment of the tiltable backboard which is similar to device 1 of FIG. 1, generally indicated at 20, except that the backboard is formed with headrest or means for flexing the head of the patient forward 16 using a generally wedged shape made of foam, rubber or any suitable material, which is firmly attached to backboard 2. Headrest 16 maintain the head of a patient elevated with respect to the chest to promote venous return from the head into the heart.

Figure 3:
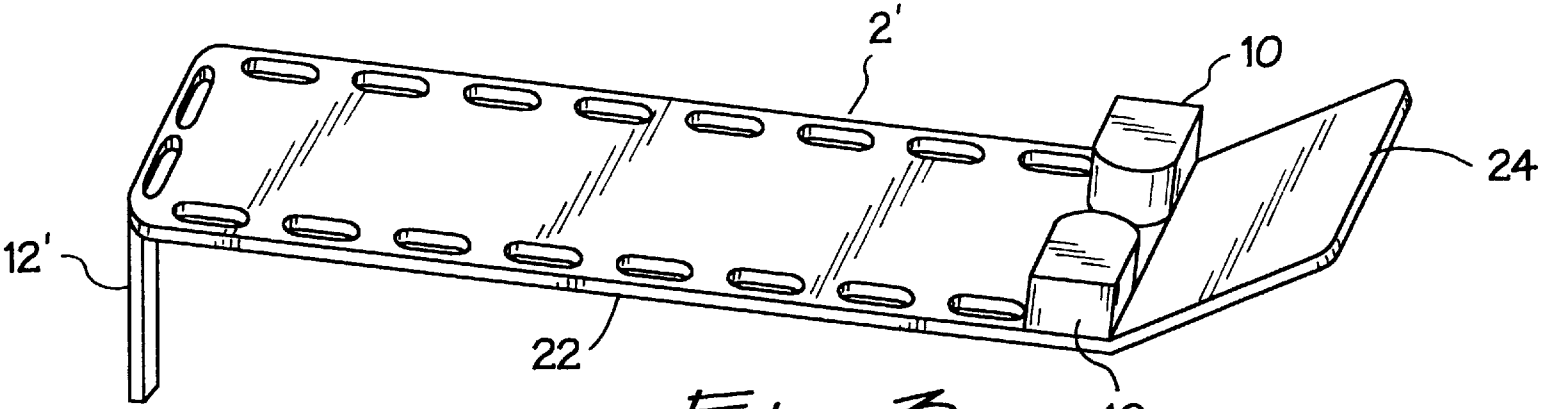
FIG. 3 is a side view of a further embodiment of the tiltable backboard in use with a headboard at a fixed angle for the elevation of the head of the patient.

FIG. 3 shows another embodiment of the tiltable backboard which is similar to device 1 of FIG. 1, generally indicated at 22, except that the backboard 2' is formed with distal segment, head rest or head board 24 joined with backboard at a fixed angle for elevation of the head of a patient. The tilting apparatus of backboard 2" may be adjustable and may tilt backboard 2" at a fixed angle.

Figure 4:
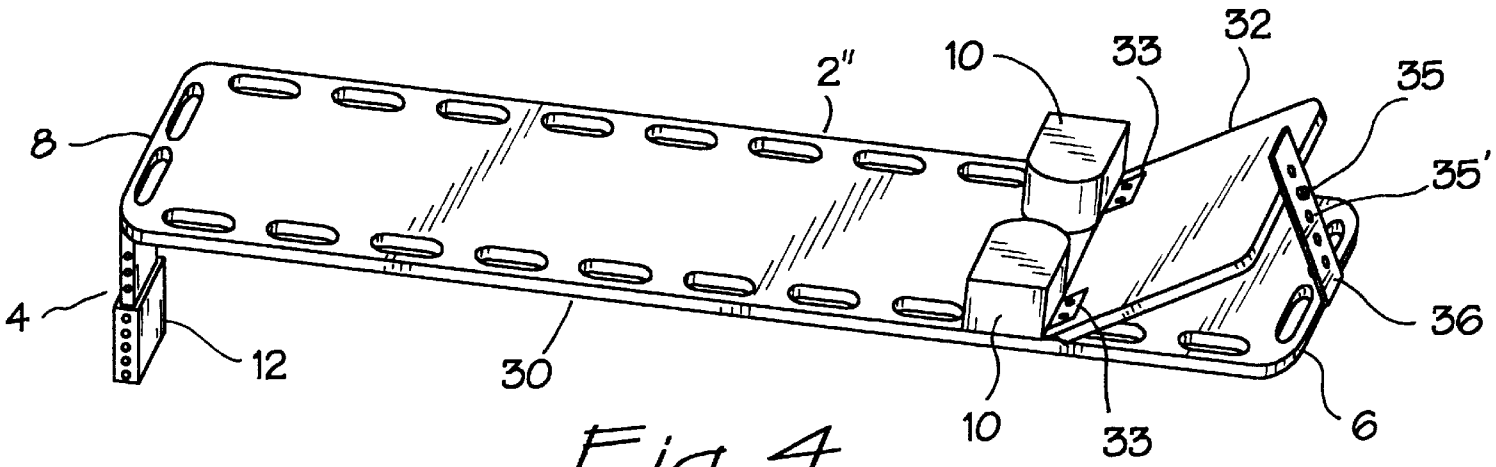
FIG. 4 is side view of a further embodiment of the tiltable backboard in use with an adjustable headboard for the elevation of the head of the patient.

FIG. 4 is a further embodiment of the tiltable backboard which is similar to device 1 of FIG. 1, generally indicated at 30, except that the backboard 2' is formed with adjustable head rest or head board 32 hinged via hinge 33 to backboard 2 for angular elevation of the head of the patient. Headboard 32 is provided with pin 35 for engagement with holes 35' of rigid plate 36 firmly attached to the distal end 6 of board 2. The angle of inclination of headboard 32 can be adjusted by engaging of pin 35 with desired hole 35' of plate 36.

Figure 5:
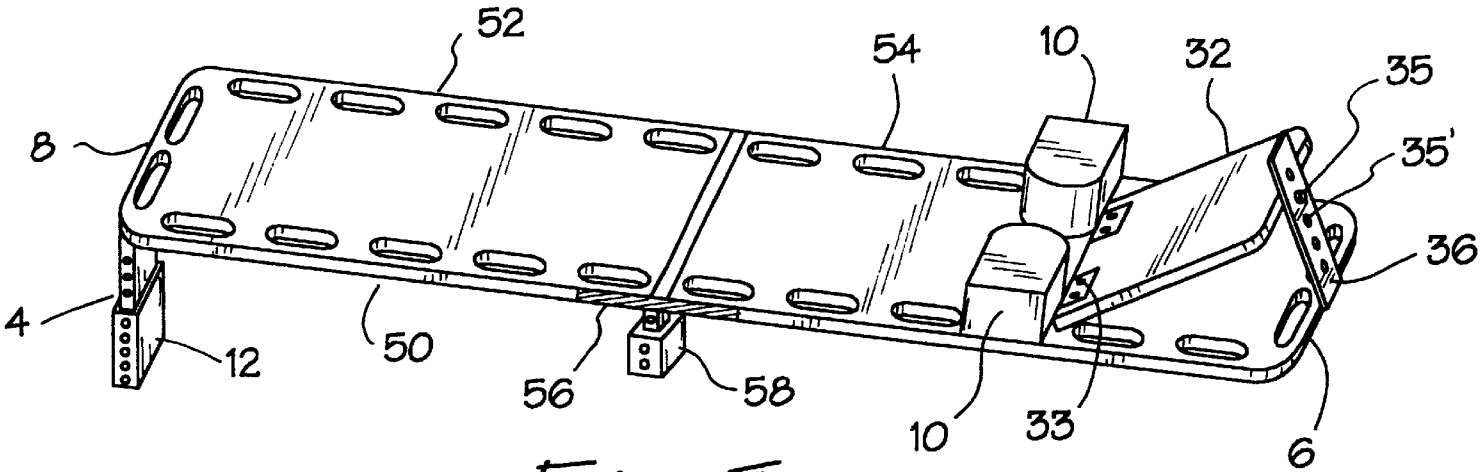
FIG. 5 is an additional view detailing the adjustable headboard of the device shown in FIG. 4.

FIG. 5 is a device all similar to device 30 of FIG. 4 except that board 50 is divided into two segments, proximal segment 54 for the patient's trunk and distal segment 52 for the patient's lower extremities, segments 52 and 54 being hinged together via hinge 56. Proximal board segment 54 is provided with adjustable support legs or means 58. Board 54 allows the practitioner to incline the lower extremities of a patient at an angle different from the angle of inclination of the patient's trunk.

Figure 6:
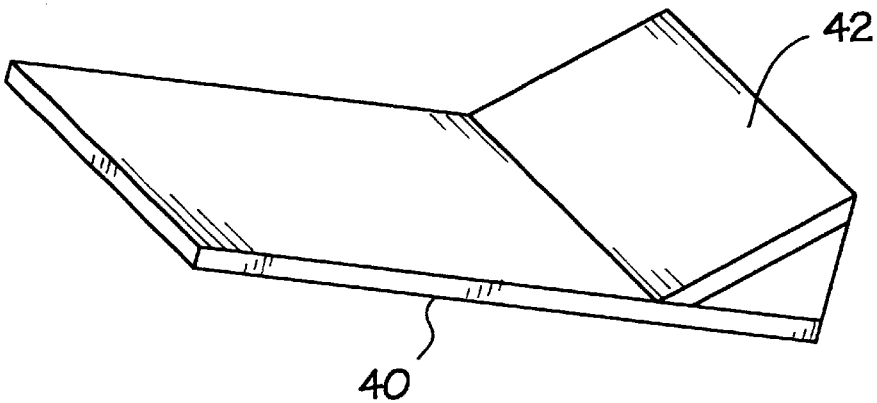
FIG. 6 is a further embodiment of the device, shorter for support of the trunk and head only.

FIG. 6 is a further embodiment of backboard 2 of FIG. 1. Generally indicated which 40 is shorter and only partially fits underneath a patient's body to provide support for the trunk and head of a patient during CPR. This board is preferably used when a patient arrests while lying on a hospital bed or gurney because such are already provided with a tilting mechanism to allow inclination of the patient's body. Device 40 is provided with headboard 42 for elevation of the head. In use, board 40 is placed underneath the trunk of a victim of cardiac arrest on top of the mattress of the hospital bed or gurney. The head of the patient is positioned over headboard 42. The bed or gurney is then inclined so that the extremities are up and the chest down while the patient's head is elevated with respect to the chest by head rest 42.

The position of the patient's body in all disclosed devices uses gravity to promote diastolic filling of the heart by improving venous blood return to the heart.

Figure 7:
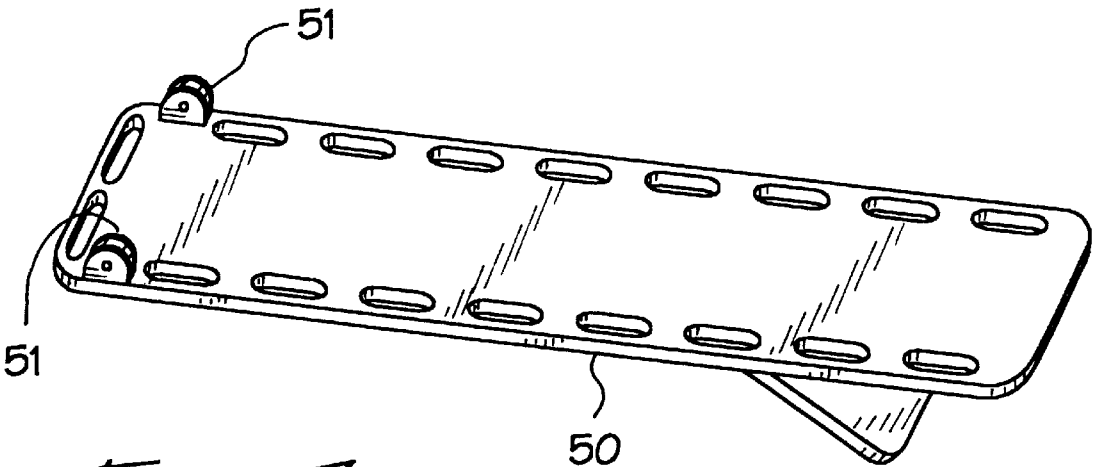
FIG. 7 is a bottom view of the device shown in FIG. 4.

FIG. 7 is a bottom view of a further embodiment of backboard 2 of FIG. 1 which is similar to backboard 2" of FIG. 4 except that in backboard 50 tilting apparatus 4 is replaced with sites 51 adapted to engage with tilting equipment suitably adapted to use such sites.

What is claimed is:

1. A method of cardiac resuscitation for a patient in cardiac arrest comprising the steps of:

1) placing the patient supine over a rigid surface 2) inclining said surface to a degree of inclination so as to position the patient's chest below the patient's abdomen and promote venous blood return from the abdomen to the chest 3) performing cardiac compression external or internal.

2. The method of claim 1 further comprising the step of flexing the head of the patient forward to elevate the head above the chest during resuscitation.

3. The method of claim 2 whereby the step of flexing the head of the patient forward to elevate the head above the chest during resuscitation includes:

placing a wedge shaped headrest at the base of the patient's head so as to flex the head forward.

4. The method of claim 1 whereby the degree of inclination of the surface is between 20–25°.

5. The method of claim 1 whereby the step of placing the patient supine over a rigid surface further includes using a rigid backboard having an apparatus for tilting the backboard in the horizontal plane.

6. The method of claim 5 wherein in the rigid backboard further includes an apparatus to engage the patient's shoulders so as to prevent the patient from sliding during resuscitation.

7. The method of claim 6 wherein the apparatus to engage the patient's shoulders so as to prevent the patient from sliding during resuscitation comprises straps attached to the backboard.

8. The method of claim 5 wherein the backboard further comprises an adjustable apparatus for tilting the backboard in the horizontal plane at a plurality of angles of inclination so as to facilitate the positioning of the patient's chest at a lower level than the patient's abdomen, pelvis, and extremities to promote venous return to the heart.

9. The method of claim 8 wherein the tilting apparatus are legs.

10. The method of claim 5 whereby the apparatus for tilting the backboard is capable of adjustment in the horizontal plane at two angles of inclination.

11. A method of cardiac resuscitation comprising the steps of:

inclining the body of a patient in cardiac arrest to a degree of inclination so as to position the patient's chest below the patient's pelvis and abdomen to promote venous blood return from the pelvis and abdomen to the chest; and performing internal direct cardiac massage with the cardiac resuscitation device for percutaneous direct cardiac massage.

12. The method of cardiac resuscitation of claim 11 wherein the step of inclining the body of the patient in cardiac arrest uses a rigid backboard which is capable of being tilted at a variety of angles of inclination.

13. The method of claim 12 wherein at least one angle of inclination is 20°.

14. A method of cardiac resuscitation of a human or animal patient, said method comprising the steps of:

A) inclining the patient's body such that the patient's chest is positioned below the patient's pelvis and abdomen, thereby promoting venous blood return from the pelvis and abdomen to the chest; and B) performing cardiac resuscitation on the patient.

15. A method according t o claim 14 wherein Step B comprises performing cardiopulmonary resuscitation.

16. A method according to claim 15 wherein Step B comprises performing closed chest cardiac compression.

17. A method according to claim 15 wherein Step B comprises performing open chest cardiac compression.

18. A method according to claim 15 wherein Step B comprises performing cardiac compression with a cardiac compression device that has been inserted into the patent's chest through an opening formed in the patent's chest wall.

19. A method according to claim 14 wherein the cardiac compression device is inserted percutaneously into the patient's chest cavity.

20. A method according to claim 14 wherein the cardiac compression device is inserted through a thoracostomy of a chest wall and used to alternately compress and decompress the patient's heart.

21. A method according to claim 14 wherein step A comprises placing the patient on a rigid backboard which is capable of being tilted at a variety of angles of inclination and causing said backboard to be tilted at an angle that promotes venous return from the patient's pelvis and abdomen to the patient's chest.

* * * * *